US005324482A

United States Patent [19]

Scaramella et al.

[11] Patent Number: 5,324,482

[45] Date of Patent: Jun. 28, 1994

[54] PIPETTE TIP PACKAGING SYSTEM

[75] Inventors: Larry G. Scaramella, La Jolla, Calif.; Jeffrey F. Boone, Charlestown, Mass.; Robert W. Arnold, San Diego, Calif.; Charles O. Peinado, Bonita, Calif.; David A. White, 3105 Azahar St., Carlsbad, Calif. 92009

[73] Assignee: David A. White, Carlsbad, Calif.

[21] Appl. No.: 936,256

[22] Filed: Aug. 27, 1992

[51] Int. Cl.[5] ..... B01L 3/02; B65D 85/00; B65D 1/34; B65D 6/04

[52] U.S. Cl. ..... 422/100; 422/104; 206/443; 206/446; 206/562; 206/563

[58] Field of Search ..... 422/100, 104; 206/443, 206/446, 562, 563

[56] References Cited

U.S. PATENT DOCUMENTS

| | | | |
|---|---|---|---|
| 3,853,217 | 12/1974 | Scordato et al. | 206/223 |
| 4,346,057 | 8/1982 | Bowser | 422/104 |
| 4,349,109 | 9/1982 | Scordato et al. | 206/562 |
| 4,895,706 | 1/1990 | Root et al. | 422/104 |
| 4,948,564 | 8/1990 | Root et al. | 422/104 |
| 5,035,866 | 7/1991 | Wannlund | 422/104 |
| 5,057,282 | 10/1991 | Linder | 422/104 |
| 5,098,663 | 3/1992 | Berthold et al. | 422/104 |

*Primary Examiner*—James C. Housel
*Assistant Examiner*—Rachel Freed
*Attorney, Agent, or Firm*—Brown, Martin, Haller & McClain

[57] ABSTRACT

A pipette tip storage and dispensing system has a series of pipette tip holder cards each of which has a plurality of openings for holding a set of pipette tips extending partway through the openings in an upright orientation. The openings in each card match those in the other cards, and cards loaded with pipette tips can be stacked vertically with the pipette tips in one card extending into the open upper ends of the tips in the next adjacent card of the stack, to minimize storage space. An alignment device is arranged to hold the pipette tips in a card in a vertical orientation as the card is removed from the top of the stack and transferred to a pipette tip holder tray so that the pipette tips can be lowered into aligned openings in the holder tray with the card resting on the top wall of the tray.

9 Claims, 3 Drawing Sheets

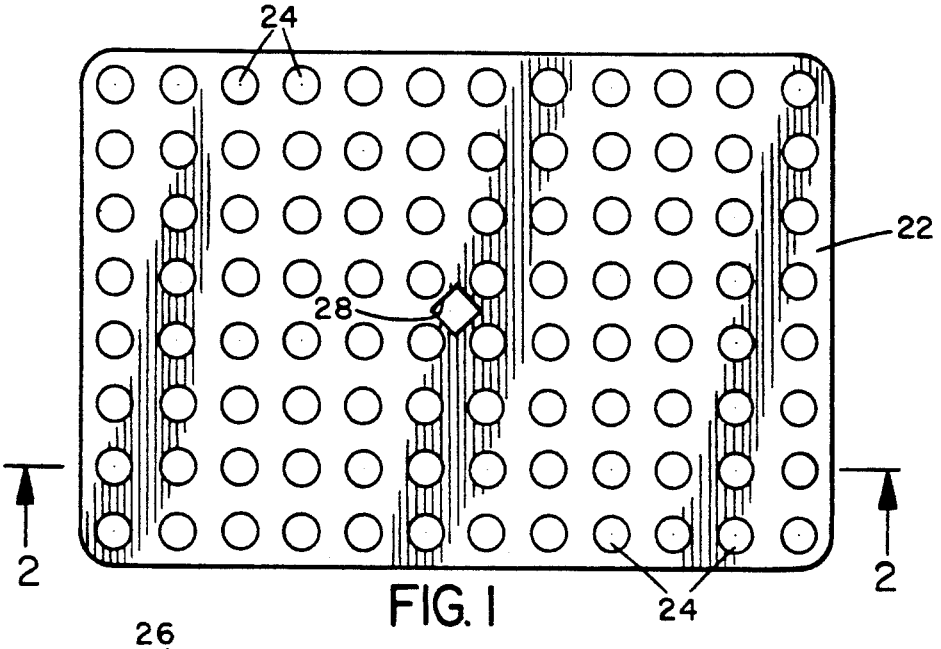
FIG. 1
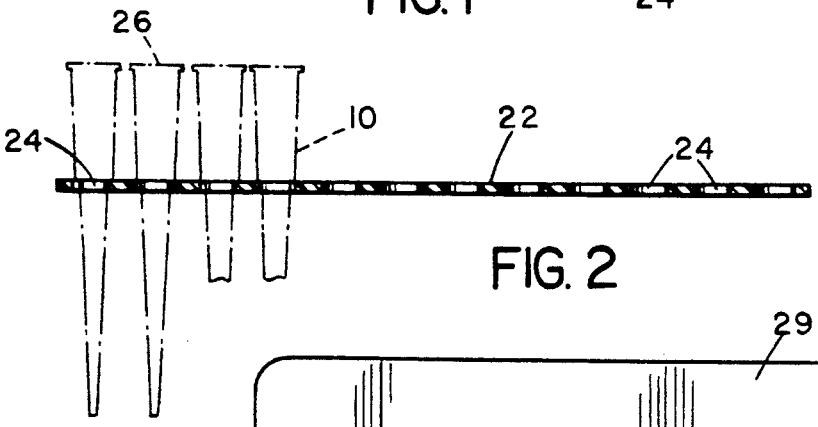
FIG. 2
FIG. 3
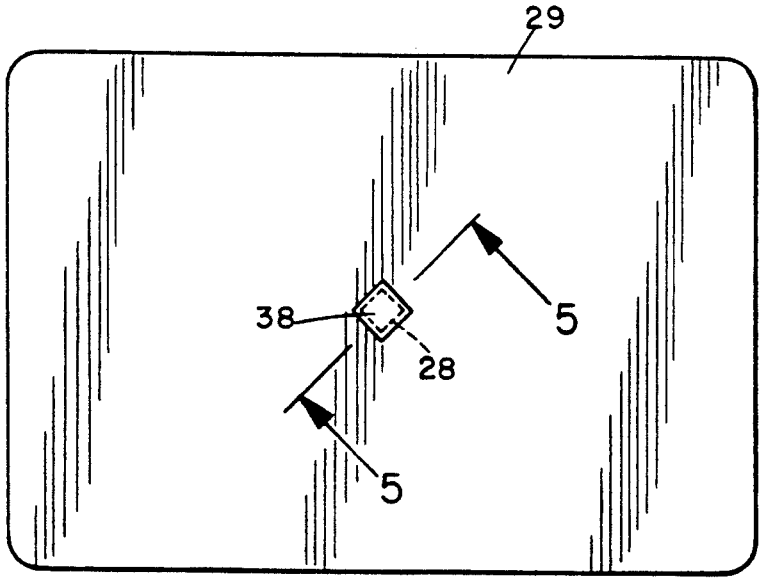
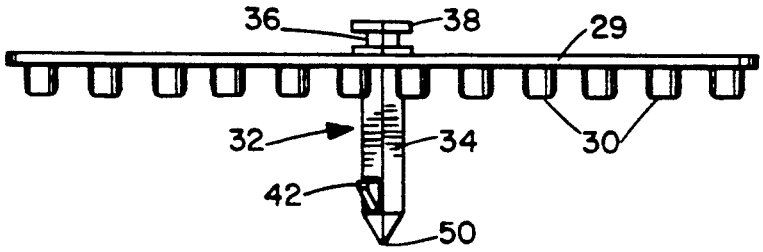
FIG. 4

PIPETTE TIP PACKAGING SYSTEM

BACKGROUND OF THE INVENTION

The present invention relates generally to a packaging system for disposable pipette tips.

Disposable pipette tips for use in syringes and pipetting devices are typically supplied in trays, each tray having openings for receiving 96 pipette tips. Typically, 10 trays are packaged in an outer box, and both the box and the trays are discarded when the tips have been used. Ten loaded pipette trays take up a lot of space and require a relatively large box, and thus a correspondingly large amount of packaging material which must be discarded. Empty trays are sometimes refilled by hand with a new set of pipette tips, but this is a very tedious and time consuming process, so empty trays are often simply discarded, further increasing the waste inherent in the current types of packaging systems.

SUMMARY OF THE INVENTION

It is an object of the present invention to provide a new and improved packaging system for pipette tips which takes up less space and therefore reduces the amount of packaging materials needed and consequently the amount of waste produced.

According to the present invention, a pipette tip packaging system is provided which comprises an outer container or box with a lid for access to the interior of the container, and a plurality of pipette tip holder plates, each plate having a plurality of openings for receiving pipette tips and holding them vertically at a location intermediate their ends, so that the loaded plates can be stacked vertically with the pipette tips in one plate nesting into the open upper ends of the aligned pipette tips in the next plate in the stack. The container is arranged to hold the stack of holder plates.

Pipette tips may be dispensed directly from the uppermost tray in the stack. However, in the preferred embodiment of the invention, a transfer plate of dimensions matching those of the holder plate is provided, the transfer plate having a plurality of bosses projecting from one of its surfaces at positions corresponding to the locations of the openings in the holder plate, the bosses being arranged to extend into the open tops of pipette tips held on the uppermost holder plate to maintain the pipette tips in a vertical orientation.

With this arrangement, an empty pipette holder tray with openings matching those in the holder plate can be refilled quickly and easily, simply by lifting the uppermost holder plate and transfer plate out of the container, aligning the pipette tips with the openings in the pipette holder tray, and lowering the holder and transfer plates until the pipette tips are engaged in the tray openings. At this point the transfer plate is lifted off, leaving the holder plate resting on the tray and the pipette tips engaged in the tray openings. The transfer plate is returned to the container and placed over the next holder plate in the stack with the bosses extending into the open ends of the pipette tips in that plate, ready to refill the tray when the loaded pipette tips have all been used.

By storing the pipette tips in holder plates rather than in closed trays, the required storage space is reduced considerably since the pipette tips can be stacked in a nesting arrangement. The arrangement also makes it considerably easier to refill an empty holder tray, so that the user will be less likely to discard such trays. Preferably, the container has one compartment for storing stacked holder plates and pipette tips, and another compartment for storing an empty pipette tip holder tray which can be used for dispensing all of the pipette tips in the stack.

In a preferred embodiment of the invention, a releasable latching mechanism is provided between the transfer plate and holder plate so that they can be lifted together as one unit. The latching mechanism may comprise a latch pin projecting from the transfer plate for releasable latching engagement in a corresponding latch opening provided in all the holder plates.

According to another aspect of the present invention, a pipette tip transfer mechanism is provided for transferring a predetermined number of pipette tips into a pipette holder tray having a rectangular array of openings for receiving the pipette tips. The mechanism includes a flat holder plate having the same number of openings as the pipette holder tray for receiving the pipettes and holding them at a location intermediate their ends. The openings in the holder plate are arranged in a rectangular array matching that of the holder tray. A flat transfer plate has a rectangular array of projections matching the array of openings in the holder tray, and the projections are dimensioned for engagement in the open tops of the pipette tips held in the holder plate.

With this arrangement, the holder plate and transfer plate can be lifted together and aligned with the holder tray openings before being lowered onto the pipette holder tray until the lower ends of the pipette tips engage in the aligned holder tray openings.

This system allows pipette holder trays to be refilled conveniently and inexpensively, so that users will be less likely to simply discard empty trays. It also reduces the overall packaging needed for a supply of pipette tips, since pipette tips held in flat holder plates and nested together in a vertical stack take up significantly less space than an equivalent number of tips held separately in holder trays. Thus, waste is reduced significantly with this invention.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which:

FIG. 1 is a top plan view of a pipette holder card forming part of a pipette tip packaging and transfer system according to a preferred embodiment of the invention for holding a group of pipette tips;

FIG. 2 is a sectional view taken on line 2—2 of FIG. 1, with several pipettes indicated in broken line;

FIG. 3 is a top plan view of an alignment plate forming another part of the system for holding pipettes in rigid alignment in the card;

FIG. 4 is a side elevation view of the alignment plate;

DESCRIPTION OF THE PREFERRED EMBODIMENT

Figure 11:
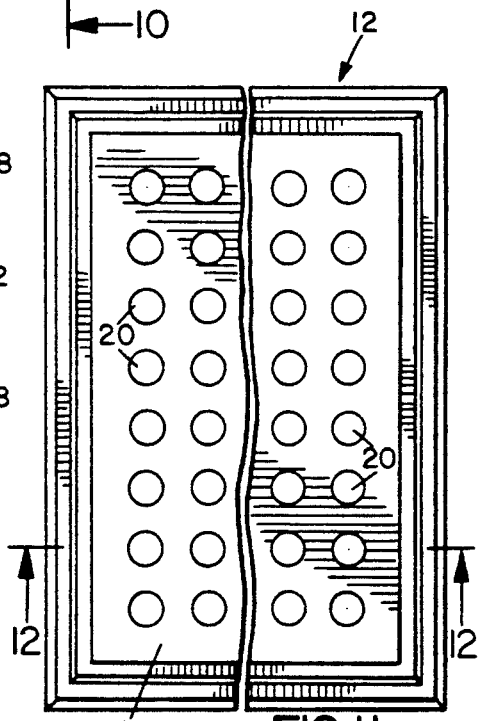
FIG. 11 is a top plan view of a holder tray for dispensing carded pipettes.

FIGS. 1 and 2 of the drawings illustrate a first part of a pipette tip packaging and transfer system according to a preferred embodiment of the present invention. Pipette tips 10 are conventionally supplied in groups of 96 held in holder trays 12 of the type illustrated in FIGS. 11 and 12. Each tray 12 is of generally rectangular shape having a base wall 14, side walls 16 and a top wall 18 in which a rectangular array of 96 openings 20 is located for receiving tips 10 as illustrated in dotted outline in FIG. 12. In typical packaging systems for supplying pipette tips, ten trays each holding 96 pipette tips are stored in a relatively large outer container so that each pipette container holds 960 pipette tips. It can be seen that there will be a significant amount of dead or unused space 21 within the tray.

The present packaging system allows an empty tray to be reloaded repeatedly with a new set of pipette tips, and also allows the tips to be stored in much less space until needed.

As illustrated in FIGS. 1 and 2, the first part of the pipette tip packaging system of the preferred embodiment of this invention comprises a flat rectangular holder card or plate 22 having dimensions substantially matching those of the top wall of conventional pipette holder trays 12, the plate 22 having an array of 96 openings 24 which are dimensioned and positioned to match the rectangular array of 96 openings 20 in conventional pipette holder trays.

As illustrated in dotted outline in FIG. 2, pipette tips 10 are inserted vertically through the openings 24 so that they are held by the openings at a location intermediate their ends, the diameter of openings 24 being less than the pipette tip diameter at the open upper end 26 of each pipette tip. The card 22 has a centrally located, square latching aperture 28 which is oriented at an offset of around 45 degrees to the sides of the card, so that the sides of the latching aperture are angled relative to the corresponding sides of the card.

FIGS. 3 and 4 illustrate the second part of the pipette tip packaging and transfer system, which comprises a rectangular alignment or transfer plate 29 of dimensions matching those of the holder card 22. The alignment plate 29 has a rectangular array of projections or bosses 30 projecting from one of its faces at positions matching those of the openings 24 in card 22. A central latching mechanism 32 projects through the center of plate 29 for engagement in the latching aperture 28 in holder card 22.

Figure 5:
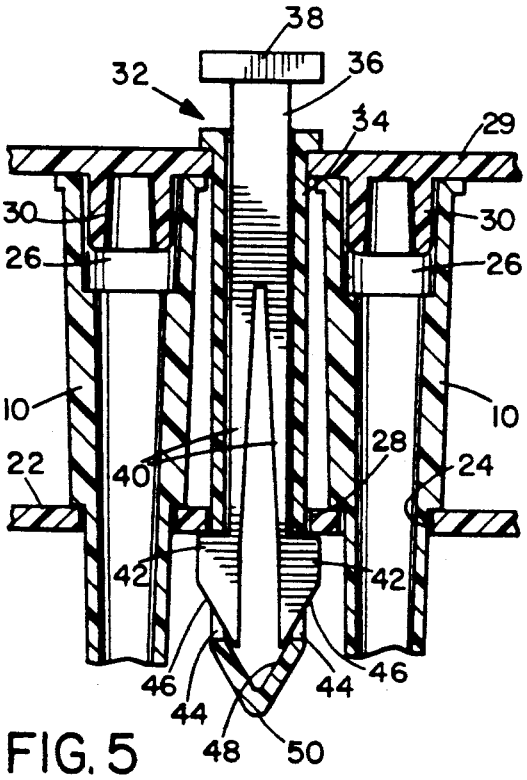
FIG. 5 is an enlarged sectional view taken on line 5—5 of FIG. 3, showing the alignment plate latched into a pipette card.
Figure 6:
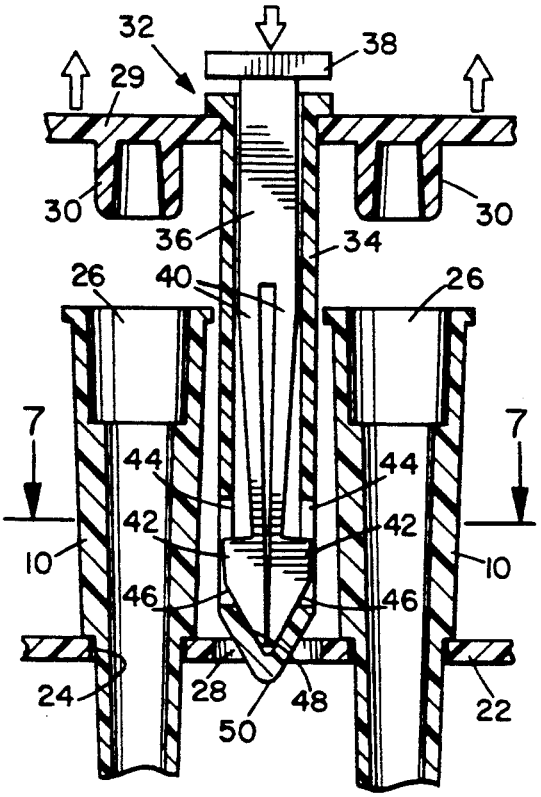
FIG. 6 is a similar sectional view with the latch released.
Figure 7:
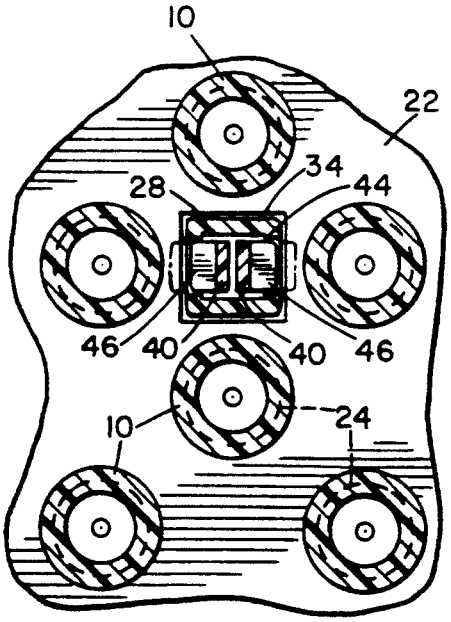
FIG. 7 is a sectional view taken on line 7—7 of FIG. 6.

The projections or bosses 30 projecting from alignment plate 29 are designed to engage in the open upper ends 26 of the pipette tips 10 supported in holder card 22, as best illustrated in FIG. 5, so as to hold the pipette tips in a rigid vertical orientation in the card. At the same time, the latching mechanism 32 is designed to releasably secure the card 22 to the alignment plate for transfer purposes, as best illustrated in FIGS. 5–7. The latching mechanism 32 basically comprises a hollow pin or post 34 having a square cross section matching that of latching aperture 28 and extending through a correspondingly-shaped opening in the alignment plate. A latching pin or plunger 36 having an enlarged head 38 at its upper end and a pair of spring loaded fingers 40 at its lower end is telescopically mounted in hollow post 34. Fingers 40 have outwardly projecting bosses 42 at their free ends which are designed to project outwardly through aligned openings 44 in the post 34 in the latching position illustrated in FIG. 5. Since the post and latch opening are of square or other non-round cross-section, relative rotation between the two plates is prevented while they are latched together.

Bosses 42 have tapered cam surfaces 46 on their outer faces which are designed to bear on corresponding cam surfaces 48 in the pointed lower end 50 of the hollow post 34 when the plunger 36 is pushed down in the post 34 in the direction of the arrow in FIG. 6. This simultaneously retracts the latching finger bosses 42 inwardly through the openings 44 and allows the holder card 22 to be released from the alignment plate. When the plunger 36 is released, it will be urged upwardly by the spring-loaded fingers until they project outwardly through openings 44 in the latching position illustrated in FIG. 5.

Figure 8:
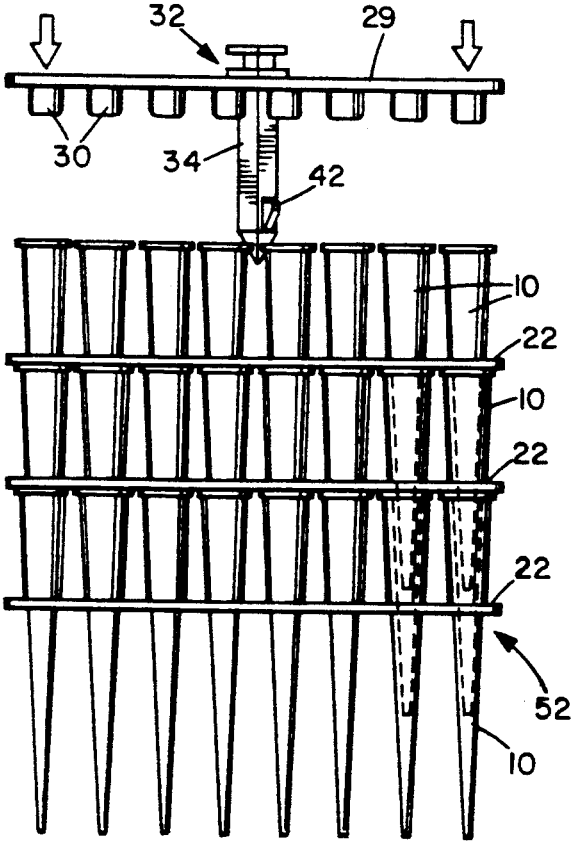
FIG. 8 is an end elevation view of a stack of carded pipettes with the alignment plate being inserted to remove the upper card.
Figure 9:
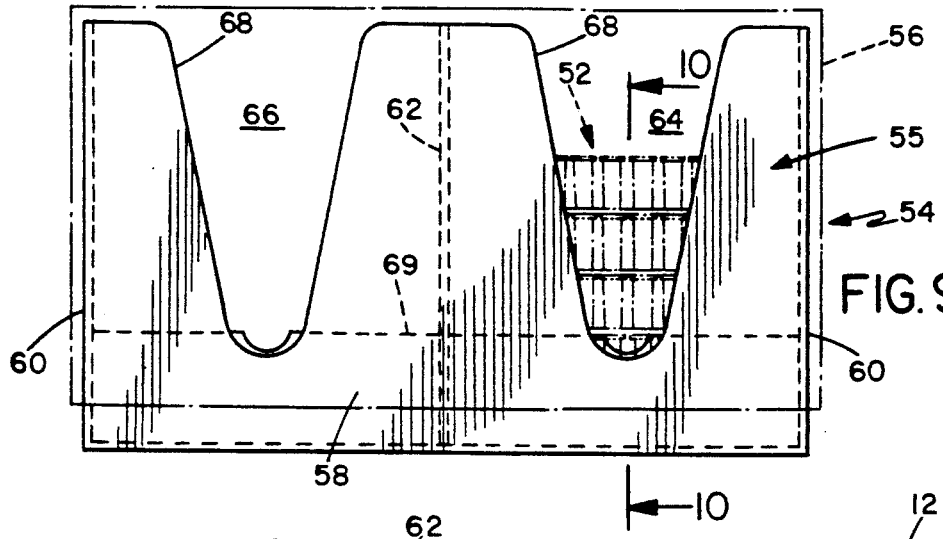
FIG. 9 is a side elevation view on a reduced scale, of a box forming another part of the packaging system for holding stacks of carded pipettes for easy access.
Figure 10:
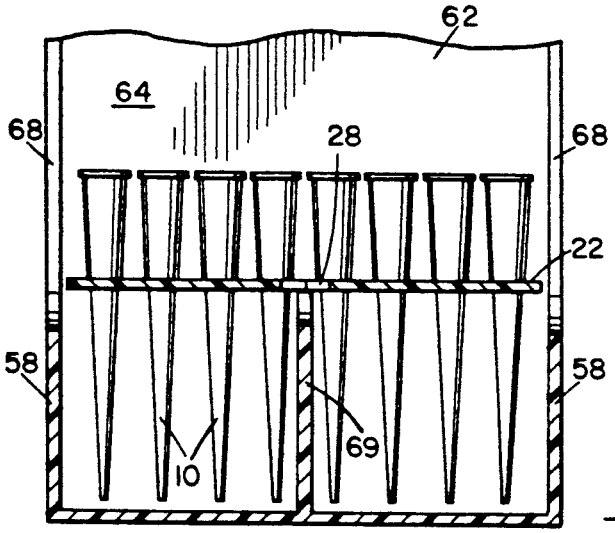
FIG. 10 is an enlarged sectional view taken on line 10—10 of FIG. 9 showing the lowermost card in the stack.

FIGS. 8–10 illustrate a complete packaging system incorporating the first two parts illustrated in FIGS. 1–7. As illustrated in FIG. 8, by holding pipette tips in a flat holder plate or card rather than in hollow, solid walled trays, dead packaging space can be eliminated and instead a series of holder cards 22 each loaded with pipette tips 10 can be stacked vertically with the lower ends of the tips in each tray apart from the lowermost tray in the stack nested into the open upper ends of the pipette tips in the underlying tray. Thus, in order to store 960 pipette tips, for example, ten loaded cards can be stacked vertically in the manner illustrated in FIG. 8 to form a stack 52 Which takes up a considerably reduced amount of packaging space. Each holder card is supported by alignment plate 29 as it is lowered onto the uppermost holder card in the stack, and the alignment plate 29 is left in latching engagement with the uppermost card ready for removal when needed. Alternatively, alignment plate 29 may be omitted and pipette tips may be dispensed directly from the uppermost card in the stack, discarding each card when it is empty so that tips can be dispensed from the next card.

Preferably, an outer box or container 54 is provided for storing the stack 52 of pipette tip holder cards, as best illustrated in FIGS. 9 and 10. The container has a rectangular base 55 and a matching lid or closure 56, illustrated in dotted outline in FIG. 9. The base has opposite side walls 58 and end walls 60, and is preferably divided by internal separating wall 62 into two separate compartments 64,66, the first of which is dimensioned to receive the stack 52 as a close sliding fit. The second compartment 66 may receive a second stack of pipette tip holder cards, but preferably holds a pipette holder tray 12 of the type illustrated in FIGS. 11 and 12 for dispensing the pipette tips from the successive cards in the stack. The side walls 58 of the base of the box have generally V-shaped cut outs 68 to enable the user to easily engage and lift each card in the stack successively with the alignment plate 29. A central divider 69 extends along the center of the base for supporting the lowermost card 22 of a stack so that the pipette tips in that card are raised above the lower wall of the base, as best illustrated in FIG. 10.

Figure 12:
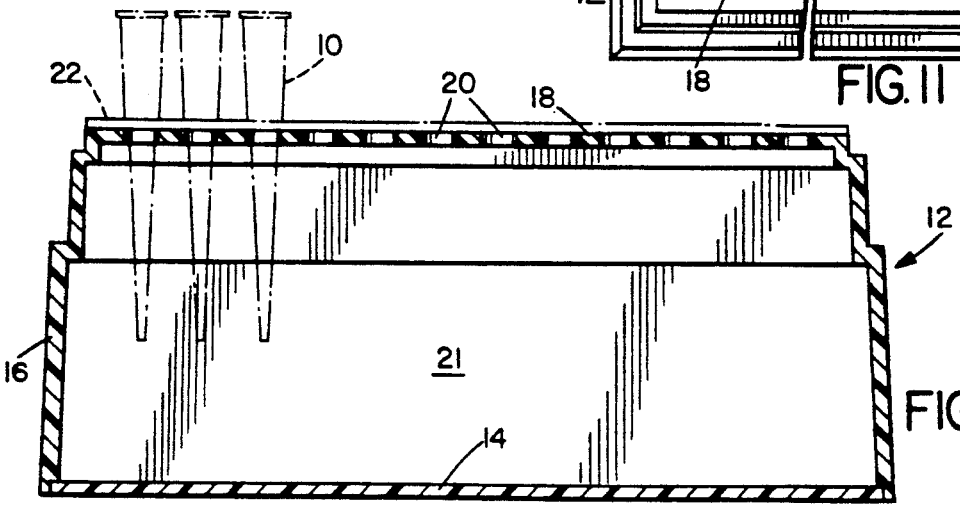
FIG. 12 is a sectional view taken on line 12—12 of FIG. 11.

In order to use the packaging system, all that is necessary is to first remove a tray 12 from the box or take any available empty tray. The alignment plate 29 will be latched to the uppermost pipette tip holder plate or card 22 in the stack with bosses 30 engaged in the open upper ends of the pipette tips 10 in that card, as illustrated in FIG. 5. The user can simply lift the alignment plate and attached card from the box, and align the pipette tips with the openings 20 in the upper wall 18 of tray 12 before lowering them onto the wall 18 so that the lower ends of the pipette tips extend through the openings 20 and the card 22 rests on the upper wall 18 of the tray, as illustrated in FIG. 12. At this point the user presses down on the top 38 of plunger 36, as illustrated in FIG. 6, so that the bosses or projections 46 are retracted into post 34, at the same time lifting the alignment plate 29 upwardly away from card 22 and pulling post 34 out through opening 28, leaving the pipette tips ready for use.

The alignment plate 29 is then returned to the box and lowered onto the next uppermost card 22 in the stack, pressing down on plunger 36 so that projections 46 are retracted to enable the post 34 to be inserted through opening 28 and the bosses 30 to engage in the upper ends of the pipette tips to hold them upright. The plunger is then released so that the projections spring back outwardly to engage beneath card 22 as illustrated in FIG. 5, holding the card ready for refilling the tray when necessary.

Thus, a pipette tip holder tray can be repeatedly loaded with pipette tips quickly and easily. The alignment plate will hold the tips upright so that they can be aligned vertically with the openings in the tray 12. The storing of the tips in flat holder cards enables the tips to be stacked vertically so that they take up considerably less storage space, while at the same time allowing the tips to be removed easily from the storage container in sets of a predetermined quantity. Although in the illustrated embodiment a conventional 96 opening pipette tip tray is used, clearly the same principles can be used for storing and dispensing groups of different numbers of pipette tips, since all that is necessary is that the openings in the holder card match those in the dispensing tray and that the projections or bosses in the alignment card similarly match the openings in the holder card.

In the alternative arrangement in which pipette tips are dispensed directly from a stack of loaded cards, the container will be reduced in size and include only compartment 64.

The required storage space is considerably reduced by avoiding the need to store pipette tips in separate holder trays, and thus avoiding a substantial amount of dead space in a storage container. The amount of packaging materials required is similarly reduced. This in turn reduces waste, and the packaging can easily be made from recyclable material. Since an empty holder tray can be reloaded in a simple one step operation, rather than having to insert individual pipette tips one-by-one by hand, the tendency to discard holder trays instead of reusing them is avoided, similarly reducing waste of materials.

Although a preferred embodiment of the invention has been described above by way of example only, it will be understood by those skilled in the field that modifications may be made to the disclosed embodiment without departing from the scope of the invention, which is defined by the appended claims.

We claim:

1. A pipette tip packaging and dispensing system, comprising:

a pipette holder tray having a base wall, side walls and a top wall, the top wall having a number of pipette tip openings for receiving a set of pipette tips in an upright orientation ready for dispensing to a pipette device;

a plurality of pipette tip holder cards, each holder card having an outer periphery and pipette tip openings positioned to match the position of at least some of the openings in the holder tray and holding a set of pipette tips in an upright orientation, each tip extending partway through a respective opening, the holder cards being stacked vertically with the pipette tips in each card nested into the open upper ends of the pipette tips in the next lowermost card in the stack; and a transfer member for transferring an uppermost card in the stack to the pipette holder tray so that the pipette tips in the card extend into the matching openings in the holder tray and the card rests on the upper wall of the tray, the transfer member having a latching mechanism for releasably securing the transfer member to a holder card as the card is transferred from the stack to a holder tray, a lower surface with a plurality of bosses projecting from said lower surface at positions matching those of the openings in the holder card, each boss being of predetermined dimensions for fitting into the open upper end of a pipette tip, and comprising means for engaging in the open upper end of a respective aligned pipette tip held in the card to hold the pipette tip upright as the card is lowered into the holder tray.

2. The system as claimed in claim 1, wherein the transfer member comprises a flat plate having an outer periphery of shape and dimensions matching those of the outer periphery of the holder card, the bosses being positioned for alignment with pipette tip carrying openings in the holder card when the plate is positioned above the holder card with the outer periphery of the plate in alignment with that of the holder card.

3. A pipette tip tray loading apparatus, comprising:

at least one pipette tip holder card having a plurality of pipette tip openings dimensioned and positioned to match the dimensions and positions of openings in an upper wall of a pipette tip dispensing tray, the pipette tip openings holding pipette tips projecting partially through the openings at a location intermediate the ends of the tips; and a transfer device for transferring the holder card to a dispensing tray, the transfer device including card holding means for releasably engaging and holding the card in a transfer position, and alignment means for holding pipette tips in the holder card in an upright vertical orientation in the transfer position of said transfer device and holder card as the card is lowered onto the upper wall of a dispensing tray with the pipette tip carrying openings of the card aligned with the corresponding tray openings so that the lower ends of the pipette tips extend into the aligned tray openings, the alignment means comprising alignment portions on said transfer device in alignment with each of the pipette tip carrying openings in the holder card in said transfer position, said alignment portions each comprising means for extending into the open upper end of a pipette tip held in a respective aligned opening.

4. The apparatus as claimed in claim 3, wherein the transfer device comprises an alignment plate having a lower surface, said alignment portions comprising a plurality of bosses projecting from the lower surface at positions matching the positions of the openings in the holder card, each boss comprising means for extending into the open upper end of a pipette tip held in a respective opening in the holder card to hold the tip upright.

5. The apparatus as claimed in claim 4, wherein the card holding means comprises releasable latching means for releasably latching the alignment plate to the holder plate as the tips are lowered onto the dispensing tray.

6. The apparatus as claimed in claim 5, wherein the holder card has a latch opening and the latching means comprises a latch pin secured to said alignment plate for extending through said latch opening, the latch pin having retractable latching projections for extending out beneath the holder card to releasably secure the alignment plate to the holder card in a latching position.

7. The apparatus as claimed in claim 6, wherein the latch pin comprises a hollow post having a lower end for projecting through said latch opening and a plunger telescopically engaged in the hollow post, the post having opposing openings at its lower end and the plunger having spring loaded opposing fingers, said latching projections being located at the ends of said fingers in alignment with said openings in said post, the plunger being moveable between a retracted position in which said projections are retracted into said post and a latching position in which said projections project out through said openings.

8. The apparatus as claimed in claim 6, wherein the latch opening and latch pin are of corresponding non-round cross-section.

9. The apparatus as claimed in claim 4, wherein each boss comprises a generally cylindrical projection from said alignment plate, said projections each having a diameter of predetermined dimensions for fitting into the open upper end of a pipette tip.

* * * * *